US008779264B2

(12) United States Patent
Meyerson

(10) Patent No.: US 8,779,264 B2
(45) Date of Patent: Jul. 15, 2014

(54) ADJUSTABLE DRUM PEDAL

(71) Applicant: Richard Marshall Meyerson, Spokane, WA (US)

(72) Inventor: Richard Marshall Meyerson, Spokane, WA (US)

( * ) Notice: Subject to any disclaimer, the term of this patent is extended or adjusted under 35 U.S.C. 154(b) by 0 days.

(21) Appl. No.: 13/789,666

(22) Filed: Mar. 7, 2013

(65) Prior Publication Data

US 2013/0233149 A1 Sep. 12, 2013

Related U.S. Application Data

(60) Provisional application No. 61/608,587, filed on Mar. 8, 2012.

(51) Int. Cl.
*G10D 13/02* (2006.01)
*G10D 13/00* (2006.01)

(52) U.S. Cl.
CPC ..... *G10D 13/006* (2013.01)
USPC ..... 84/422.1

(58) Field of Classification Search
CPC ..... G10D 13/006
USPC ..... 84/422.1
See application file for complete search history.

(56) References Cited

U.S. PATENT DOCUMENTS

| | | | | |
|---|---|---|---|---|
| 2,446,508 | A * | 8/1948 | Crowell | 84/422.1 |
| 2,551,635 | A * | 5/1951 | Ramsey | 84/422.1 |
| 5,421,234 | A * | 6/1995 | Liao | 84/422.1 |
| 5,540,131 | A * | 7/1996 | Shigenaga | 84/422.1 |
| 5,574,237 | A | 11/1996 | Yanagisawa | |
| 5,714,701 | A * | 2/1998 | Hsieh | 84/422.1 |
| 5,895,168 | A * | 4/1999 | Liao | 403/362 |
| 6,894,210 | B1 * | 5/2005 | Lombardi | 84/422.1 |
| 6,903,257 | B2 * | 6/2005 | Yun | 84/422.1 |
| 7,449,626 | B2 * | 11/2008 | Chen | 84/422.1 |
| 7,579,539 | B2 | 8/2009 | Chen | |
| 7,579,540 | B2 | 8/2009 | Takegawa | |
| 7,956,268 | B1 * | 6/2011 | Liao | 84/422.1 |
| 2013/0233149 | A1 * | 9/2013 | Meyerson | 84/422.1 |

FOREIGN PATENT DOCUMENTS

EP 1959426 A 8/2008

OTHER PUBLICATIONS

Pearl Drum Demon Drive, viewed Apr. 11, 2014, missing NPL in IDS dated Nov. 22, 2013.* www.demondrive.pearldrum.com, Eliminator Demon Drive: The Fastest, Smoothest, Most Versatile Pedal in the World, retrieved from the Internet on Nov. 7, 2013.

* cited by examiner

*Primary Examiner* — Robert W Horn

(57) ABSTRACT

Representative implementations of devices and techniques provide an adjustable drum pedal assembly. One or more levers may be slideably adjustable with respect to a drive shaft of the pedal. The one or more levers may include a mount for a drum beater, a drive cam mechanism, or the like. Further, a footboard of the pedal may be slideably adjustable with respect to a position relative to the drive shaft.

20 Claims, 8 Drawing Sheets

ADJUSTABLE DRUM PEDAL

PRIORITY CLAIM AND CROSS-REFERENCE TO RELATED APPLICATION

This application claims the benefit under 35 U.S.C. §119 (e)(1) of U.S. Provisional Application No. 61/608,587, filed Mar. 8, 2012, which is hereby incorporated by reference in its entirety.

BACKGROUND

Adjustable drum pedals are available that have one or more ways of altering the leverage of the pedal action and/or enabling the drummer to customize the feel of the pedal to his or her preference. However, the adjustment capability of some of these pedals is limited to a fairly narrow range. For example, in some cases, few adjustments are possible or the possible adjustments are limited to discrete values. Additionally, some pedals are not easy to adjust from the sitting/playing position.

In general, adjustable drum pedals tend to lack adjustability in one or more key areas, most notably, the cam mechanism. The cam mechanism is the portion of the pedal that converts the downward motion of the foot into forward motion of the beater that strikes the head of the bass drum. For example, a cam mechanism may be coupled to the pedal and move (rotate, for example) as the pedal is depressed. The cam mechanism may also be coupled to a drive mechanism (e.g., a rotating drive shaft) that operates the drum pedal beater according to the cam profile.

Different approaches have been used to address cam adjustability, including: using hinged cams (leverage is increased by putting screws behind the cams which cause them to hinge outward); using cams with indexed stops (leverage increases at each indexed increment, for example); and the use of a link to the footboard which slides upon a rail, for example, where moving the link towards the bass drumhead increases the leverage, and moving it away from the drumhead decreases the leverage.

Another approach uses a mechanism to move the footboard of the pedal forward and backward to increase or decrease the leverage of the mechanism relative to the cam. This technique can include 3 incremental "stops," for example, to change the footboard position relative to the cam to adjust the leverage. However, the user is limited to the "stops" provided on the mechanism, and is unable to fine-tune the footboard adjustment beyond the supplied positions.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations and photos of the figures are for example, and others shapes and or dimensions may be used and remain within the scope of the disclosure, unless specified otherwise.

DETAILED DESCRIPTION

Introduction

Representative implementations of devices and techniques provide an adjustable drum pedal assembly. In various implementations, one or more levers may be slideably adjustable with respect to a drive shaft of the pedal. The one or more levers may include a mount for a drum beater, a drive cam mechanism, or the like. Further, a footboard of the pedal may be slideably adjustable with respect to a position relative to the drive shaft.

In one implementation, as shown and described with respect to FIGS. 1-7, a drum pedal assembly comprises a mandrel coupled to a drive shaft of the drum pedal assembly; a cam device arranged to determine a rate of rotation of the drive shaft; and a lever coupled to the cam device and slideably coupled to the mandrel, the lever operative to adjust a distance of the cam device from the drive shaft, the lever arranged to rotate on a rotational axis of the drive shaft.

In another implementation, as shown and described with respect to FIGS. 1-7, a drum pedal assembly comprises a mandrel coupled to a drive shaft of the drum pedal assembly; a cam device arranged to determine a rate of rotation of the drive shaft; a first lever coupled to the cam device and slideably coupled to the mandrel, the first lever operative to adjust a distance of the cam device from the drive shaft; a beater device arranged to strike a percussion surface; a second lever coupled to the beater device and slideably coupled to the mandrel, the second lever operative to adjust a camber of the beater device with respect to the percussion surface; a footboard arranged to actuate the drive shaft; and a heel plate coupled to the footboard and slideably coupled to a base of the drum pedal assembly, the heel plate operative to adjust a distance of a point on the footboard from the drive shaft.

Techniques and devices are discussed with reference to example pedal devices and systems illustrated in the figures. However, this is not intended to be limiting, and is for ease of discussion and illustrative convenience. The techniques and devices discussed may be applied to many of various pedal assembly and device designs, and the like, and remain within the scope of the disclosure. In alternate implementations, the drum pedal may be employed in other ways or with other devices, systems, instruments, or the like.

Implementations are explained in more detail below using a plurality of examples. Although various implementations and examples are discussed here and below, further implementations and examples may be possible by combining the features and elements of individual implementations and examples.

Example Pedal Assembly

Figure 1:
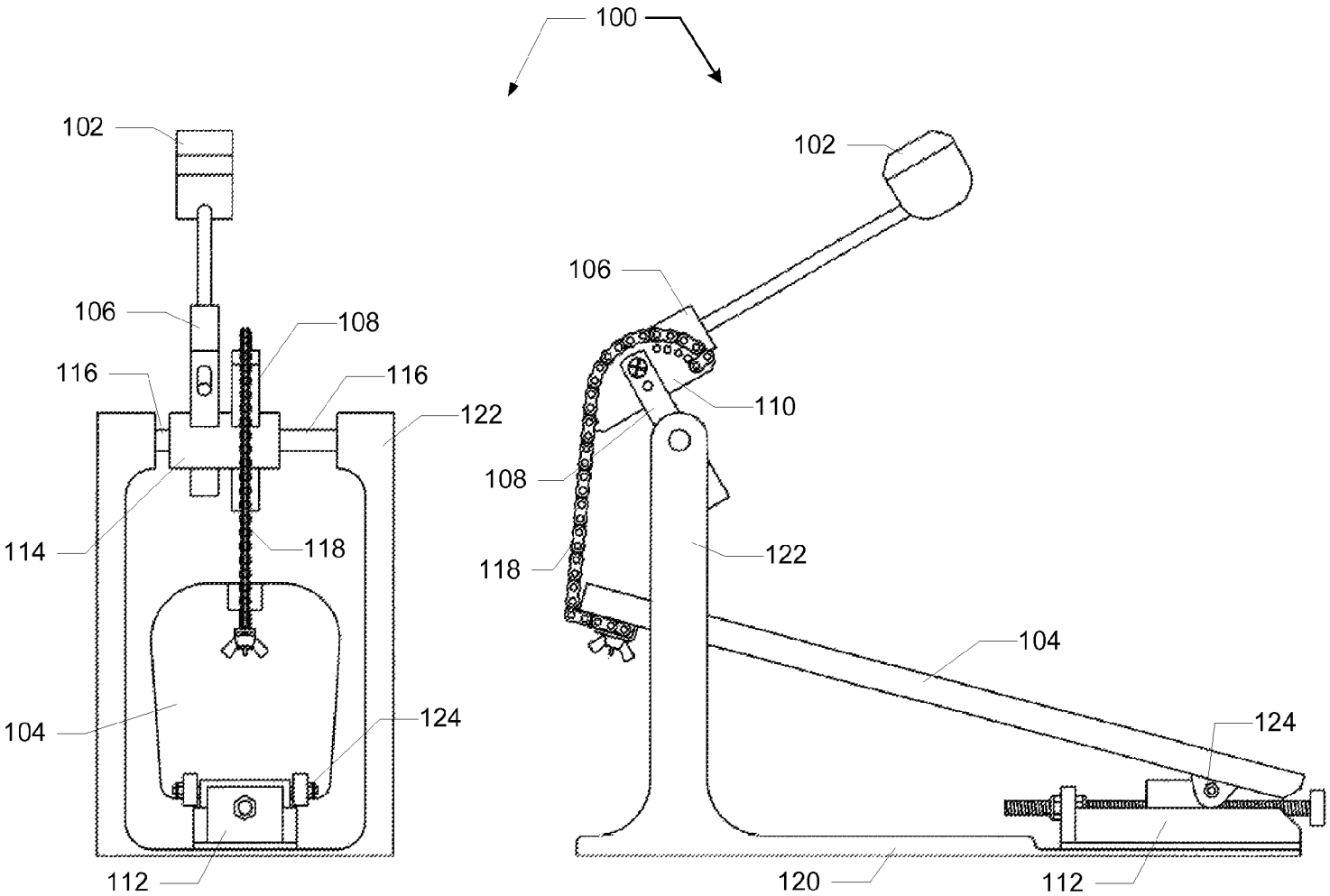
FIG. 1 is a left-side profile view and a front view of a drum pedal assembly, according to one embodiment.
Figure 2:
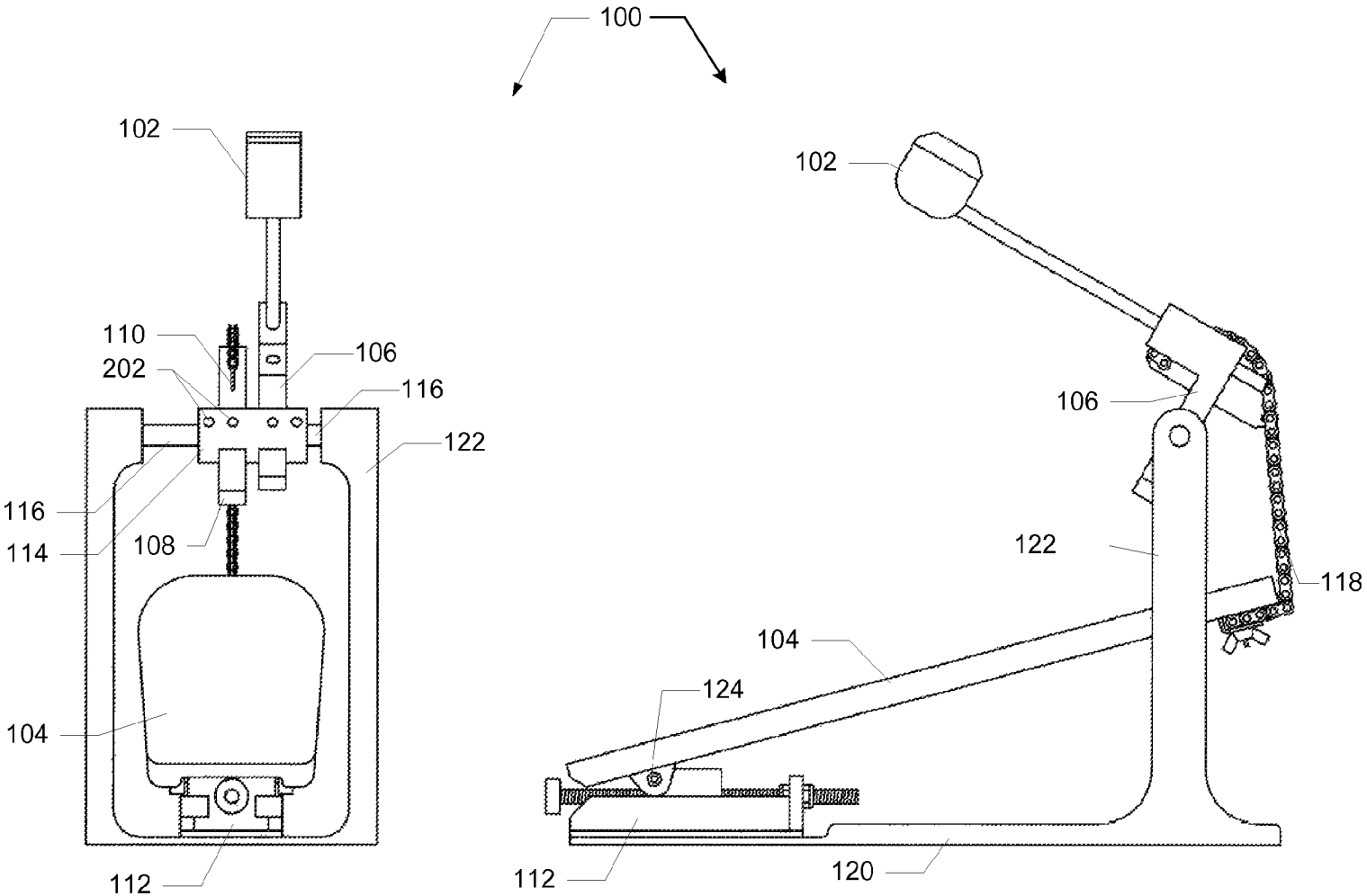
FIG. 2 is a right-side profile view and a back view of the drum pedal assembly of FIG. 1, according to one embodiment.
Figure 3:
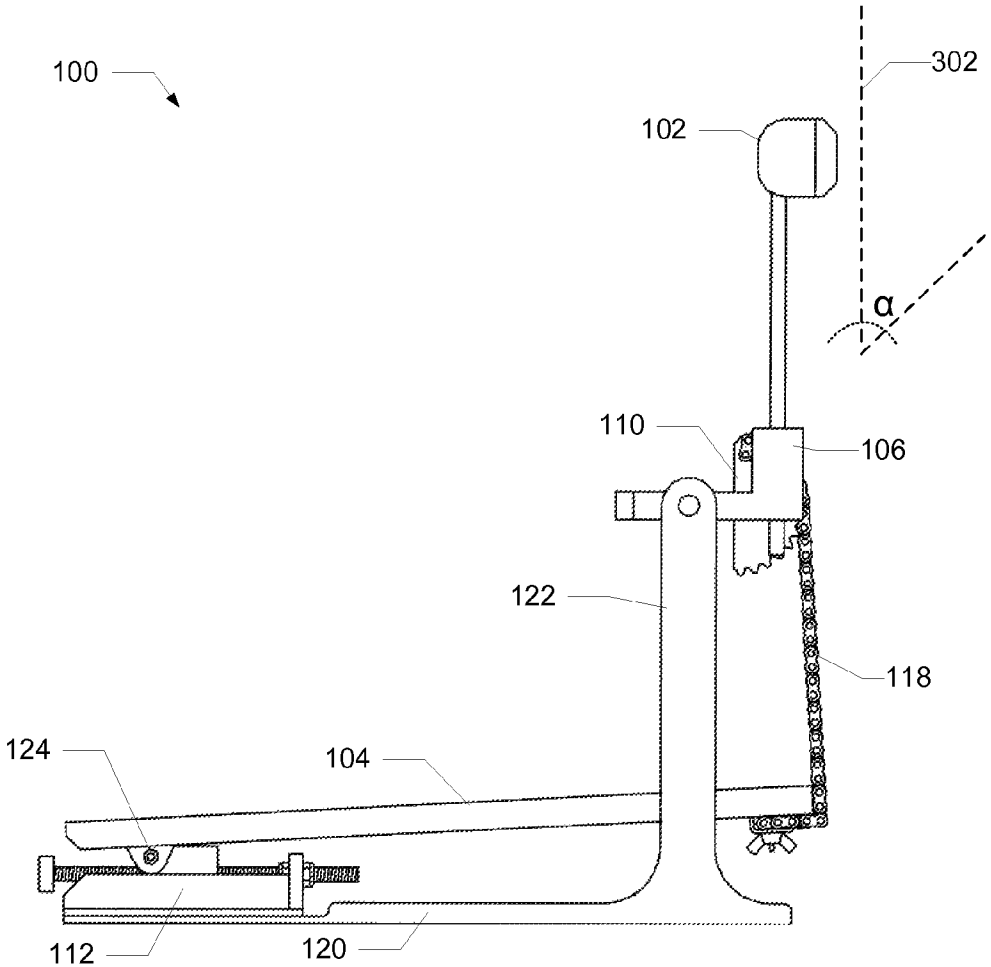
FIG. 3 is a right-side profile view of a drum pedal assembly, in an actuated state, according to one embodiment.

Referring to FIGS. 1 through 3, and 7, an example drum pedal assembly 100 ("pedal assy") is shown, for use with a musical drum and/or musical drum kit, for instance. In various embodiments, the pedal assy 100 is actuated by a user, for example, to cause one or more beaters 102 coupled to the pedal assy 100 to strike a drumhead, percussion surface, and the like, when the pedal assy 100 is actuated (as shown in FIG. 3, for instance). For example, a user may depress the footboard 104 of the pedal assy 100 with the user's foot, causing a beater 102 to strike the head of a bass drum mounted at floor level, for instance. In various embodiments, the pedal assy 100 may have any number of beaters 102 arranged to strike one or more drums or other percussion devices, instruments, and the like, arranged or mounted in any manner desired. Further, any number of pedal assys 100 may be coupled together as described below.

In various embodiments, the pedal assy 100 includes one or more mechanisms with infinite adjustment capability to fine-tune reach and/or leverage of the pedal assy 100. For example, a pedal assy 100 may include one or more of an adjustable beater lever 106, an adjustable drive lever 108, a cam device 110, and/or an adjustable heel plate 112. Fine adjustments of any or all of these mechanisms allow a user to adjust the action and feel of the pedal assy 100, as well as the comfort and effort of use. Further, infinite adjustability allows an infinite number of possible combinations for individual users' playing preference.

As shown in FIGS. 1 and 2, an example pedal assy 100 may also include a mandrel 114, a drive shaft 116, a drive chain 118 (or the like), and a base 120. In some implementations, the base 120 may include one or more integral or removable standards 122. In alternate implementations, a pedal assembly 100 may include fewer components, additional components, or alternate components to perform the functions discussed, or for other desired functionality.

Example Adjustable Levers

Referring to FIGS. 1 through 3, and 7, in an implementation, one or more sliding levers (106 and/or 108) may be movably (i.e., slideably) coupled to a mandrel 114 to provide adjustability of the drive action (e.g., the cam action) and the beater action of the drum pedal. In an embodiment, the drive lever 108 and the beater lever 106 are infinitely adjustable forward and rearward through openings 402 in the mandrel 114.

In an embodiment, the pedal assy 100 includes a beater device 102 coupled to the drive shaft 116 and arranged to strike a percussion surface (e.g., drumhead, etc.) based on a rotation of the drive shaft 116. For example, in the embodiment, the pedal assy 100 also includes a beater lever 106 coupled to the beater device 102 and slideably coupled to the mandrel 114, where the beater lever is operative to adjust a camber of the beater device 102 with respect to the percussion surface.

Figure 4:
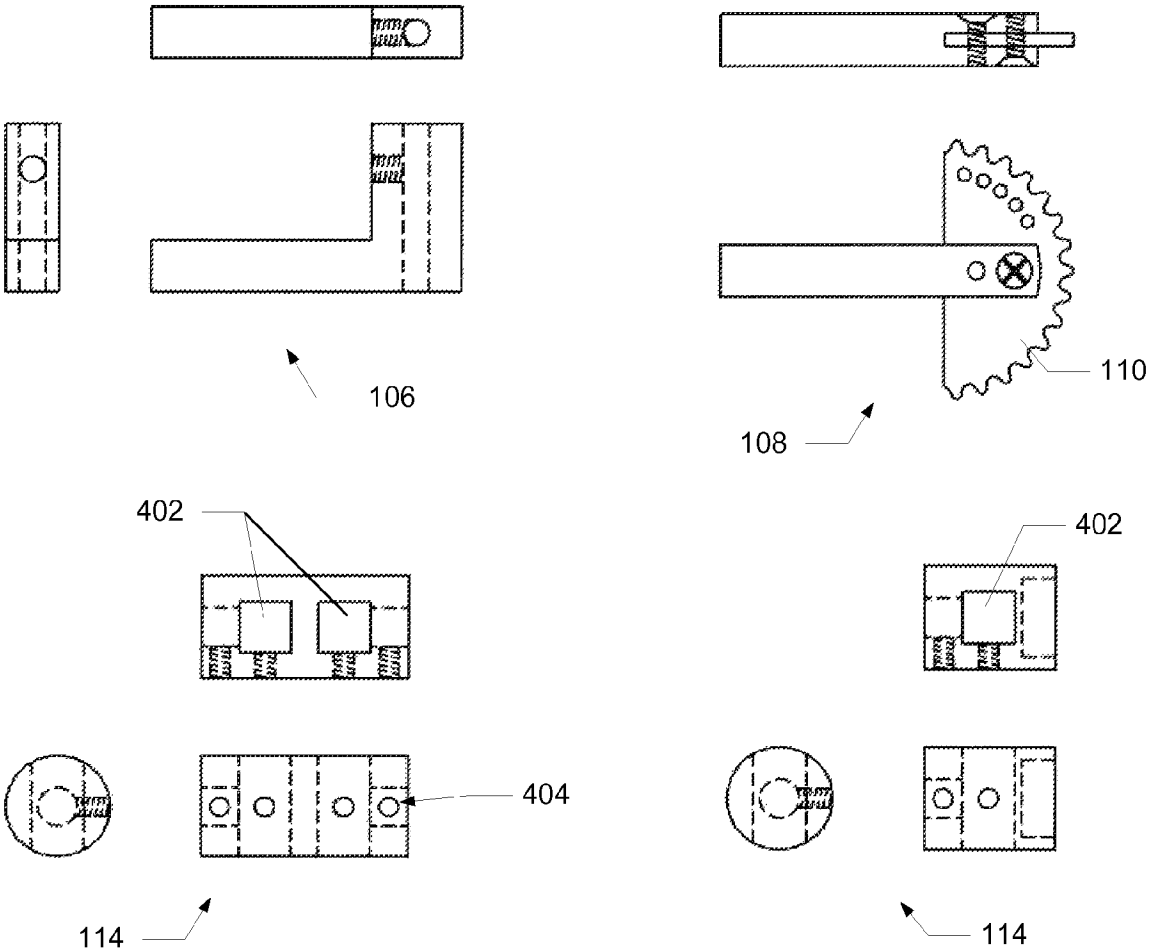
FIG. 4 includes section views of an example beater lever, an example drive lever, and an example mandrel, according to one embodiment.

For instance, in various embodiments, the adjustable beater lever 106 holds the drum beater 102, and is used to control the proximity of the beater 102 to the drumhead, changing the attack angle $\alpha$, or "camber" of the beater 102 to the drumhead (as shown in FIG. 3). The beater lever 106 is shown in FIG. 4 as an approximately "L" shaped lever arm. In various embodiments, beater lever 106 may be any of various shapes and/or cross-sections (e.g., polygonal, elliptical, etc.) that allow the beater lever 106 to couple a beater 102 to the pedal assy 100 in an adjustable manner. For example, beater lever 106 may be inserted into one of the openings 402 in the mandrel 114, slideably-adjusted to a desired position, and secured to the mandrel 114 via setscrews 202 (or other fasteners, etc.).

Changing the attack angle $\alpha$ of the beater 102 changes the rebound characteristics of the beater 102. For example, if the beater 102 is considered to be at a "zero camber" when it is parallel to the drumhead at impact, then moving the beater lever 106 forward creates negative camber and more rebound. Moving the beater lever 106 rearward has the opposite effect on the camber and the rebound characteristics. The beater lever 106 may be slideably adjusted in infinite increments (i.e., slideably adjusted in one of an infinite quantity of positions along a length of the beater lever 106), changing the attack angle $\alpha$ of the beater 102 with respect to the drumhead and allowing each drummer (i.e., user) to achieve a desired "feel."

In various embodiments, an adjustable drive lever 108 is used to control the leverage of the foot pedal 104 mechanism as it is used to actuate the beater 102. In various embodiments, the drive lever 108 may be any of various shapes and/or cross-sections (e.g., polygonal, elliptical, etc.) that allow the drive lever 108 to couple the pedal 104 to a drive assembly in an adjustable manner. For example, as shown in FIGS. 1 and 2, a drive lever 108 may be inserted into one of the openings 402 in the mandrel 114, slideably-adjusted to a desired position, and secured to the mandrel 114 via setscrews 202 (or other fasteners, etc.).

In various embodiments, the drive lever 108 may be coupled to the pedal 104 by a solid or flexible link 118, (e.g., solid metal link, flexible strap, chain, or the like). The drive lever 108 may also be slideably adjusted forward and rearward in infinite increments (i.e., slideably adjusted in one of an infinite quantity of positions along a length of the drive lever 108), changing its position within the opening 402 of the mandrel 114. For example, to control the leverage of the drive mechanism, the drive lever 108 may be slid forward to increase the leverage, or rearward to decrease the leverage.

In various embodiments, as shown in FIG. 4, the mandrel 114 has a cylindrical shape, with a circular cross-section. However, in alternate implementations, the mandrel 114 may have any desired shape (e.g., a polygonal prism, an elliptical cylinder, etc.) that allows the mandrel 114 to be coupled to a drive shaft 116 and have one or more openings (i.e., channels) 402 through the mandrel 114 arranged to receive the levers (106 and/or 108).

Further, the mandrel 114 may have any size or shape of shaft opening(s) 404 to accommodate the size and shape of the drive shaft(s) 116 used. For example, the drive shaft(s) 116 may have a rectangular or other polygonal cross-section of a larger or smaller size. Additionally, the mandrel 114 is shown in FIG. 4 as having rectangular openings 402. In various embodiments, the mandrel 114 may have one or more openings 402 of any size or shape (polygonal, elliptical, etc.) to accommodate one or more of the levers (106 and/or 108). The openings 402 may be at any desired angle with respect to the orientation of the mandrel 114 to the drive shaft 116. For example, the openings 402 may be perpendicular with respect to the orientation (i.e., the rotational axis) of the mandrel 114, as shown in FIGS. 1, 2, and 4, or the openings 402 may have another angle as preferred by the user.

In one embodiment, the mandrel 114 includes at least two openings (i.e., channels) 402 through the mandrel 114, where each channel is perpendicular to the rotational axis of the mandrel 114, and where the drive lever 108 and beater lever 106 are inserted (one each) into the two channels 402. In an example, the at least two channels 402 are parallel to each other.

The mandrel 114 is shown in FIGS. 2 and 4 as using setscrews 202 to secure the levers 106 and/or 108, and to couple to the drive shaft(s) 116. However, any of various types of fasteners 202 (e.g., pins, rivets, screws, etc.) may be used to couple the mandrel 114 to one or more drive shafts 116 and/or to couple levers (106 and/or 108) to the mandrel 114.

In an embodiment, the drive shaft 116 comprises two or more shaft sub-sections, and each end of the mandrel 114 is coupled to a shaft sub-section. For instance, in one implementation, as shown in FIG. 2, for example, a sub-section of the drive shaft 116 is inserted into each end of the mandrel 114 and a set screw 202 is tightened through the mandrel 114 onto a drive shaft 116, securing the mandrel 114 to the drive shaft 116.

In FIGS. 1 through 3, a drive shaft 116 is shown movably coupled to one or more upright portions (e.g., 122) of the pedal assy 100. FIG. 4 illustrates an example mandrel 114, shown without levers inserted in the openings 402 for clarity. In FIGS. 2 and 4, the four setscrew 202 locations are visible. In various embodiments, the two outside setscrews 202 fix the mandrel 114 to the drive shaft(s) 116, and the two inside setscrews 202 lock the sliding arms (106 and/or 108) into position within the mandrel 114. In various embodiments, any number of set screws 202 (or other fasteners) may be used to secure the mandrel 114 to the drive shaft(s) 116 and the levers (106, 108) to the mandrel 114.

In one embodiment, the mandrel 114 is fixed on a center axis to the pedal main shaft (i.e., drive shaft 116) and rotates with the drive shaft 116, returning to a start position using a spring mechanism, or the like (not shown). For example, in the embodiment, the mandrel 114 is coupled to the drive shaft 116 such that a center axis of the mandrel 114 is aligned to a center axis of the drive shaft 116, the center axis of the drive shaft 116 comprising a rotational axis of the drive shaft 116. In an alternate implementation, the mandrel 114 may be coupled to the drive shaft 116 such that a center axis of the mandrel 114 is offset from a center axis of the drive shaft 116, where the center axis of the drive shaft 116 is the rotational axis of the drive shaft 116.

In various embodiments, additional beater 102 angle adjusting devices may be used in conjunction with those described herein. Additional adjusting devices may include springs, cams, levers, stops, and the like.

In another implementation, as shown in FIG. 2, one or more of the levers (106, 108) are inserted into one or more of the openings 402 in the mandrel 114, slideably-adjusted to a desired position, and secured to the mandrel 114 via setscrews 202 (or other fasteners, etc.). In an embodiment, at least one of the drive lever 108 and beater lever 106 rotates on a rotational axis of the drive shaft 116.

Figure 5:
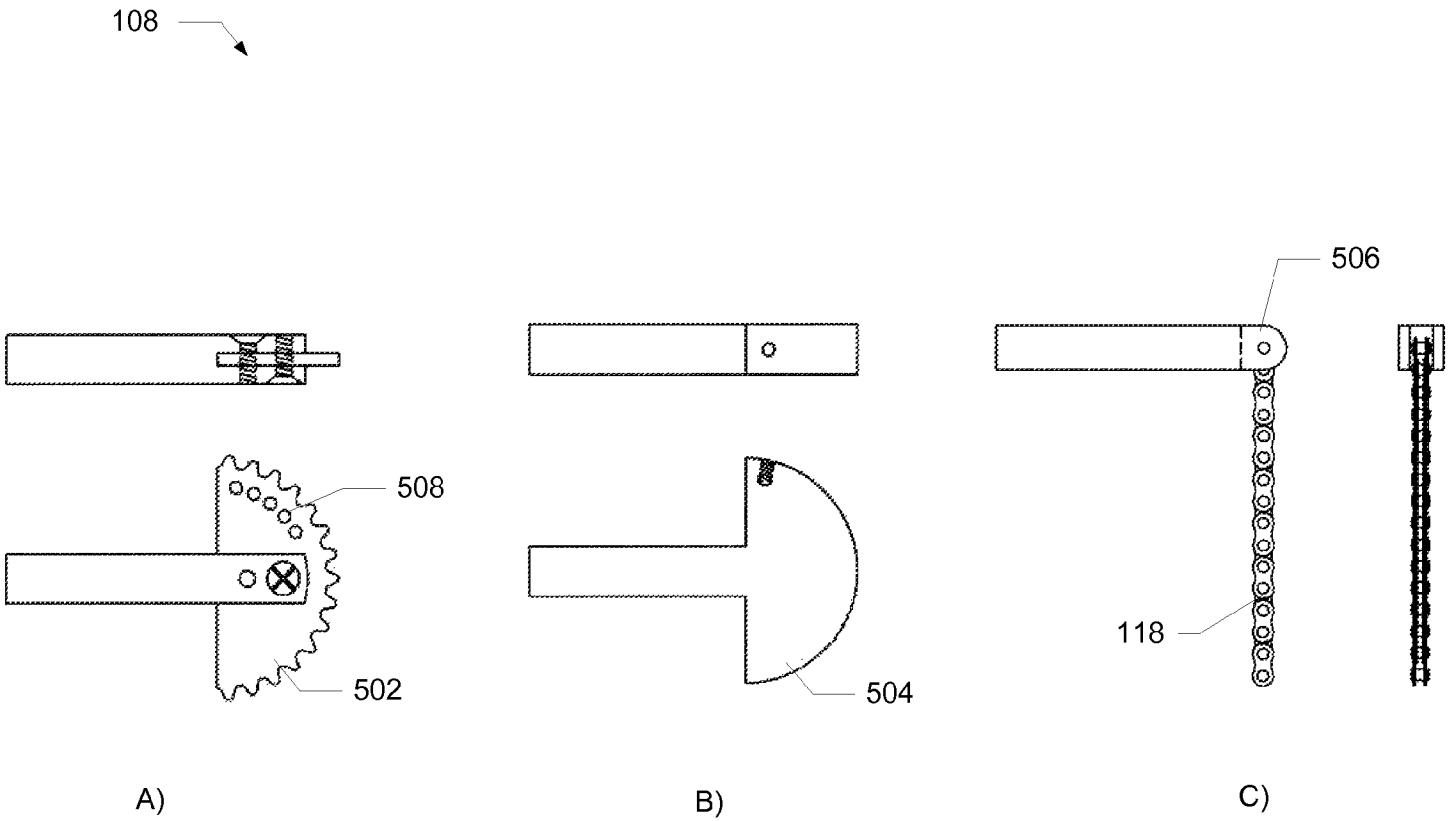
FIG. 5 illustrates three example drive levers, according to various embodiments.

Three examples of drive levers 108 are illustrated in FIG. 5. A drive lever 108 may include a cam device 110 (or connection device 110) to assist in performing the drive operation of the drive lever 108, with respect to actuation of the foot board 104, for example. In one example, a drive lever 108 is shown with a sprocket 502 or a portion of a sprocket 502 as the cam device 110, at illustration A) of FIG. 5. An example drive lever 108 with a sprocket 502 or a portion of a sprocket 502 may be used with a chain 118 for example, attached to the foot pedal 104. In an example, depressing the foot pedal 104 pulls on the chain 118 for example, and rotates the mandrel 114 and drive shaft 108 via the sprocket 502. A number of teeth on the sprocket 502 may determine a rate of drive shaft 116 rotation when the foot pedal 104 is depressed. In various embodiments, sprockets 502 may be interchangeable by a user based on any desired rate of drive shaft 116 rotation.

At illustration B) of FIG. 5, drive lever 108 is shown with a smooth cam 504 as the cam device 110. An example drive lever 108 with a smooth cam 504 may be used with a chain 118, strap, or similar flexible component, attached to the foot pedal 104. Again, depressing the foot pedal 104 pulls on the strap for example, and rotates the mandrel 114 and drive shaft 116 via the cam 504. The shape of the cam 504 along with an attachment orientation of the cam 504 with respect to the mandrel 114 may determine a rate of drive shaft 116 rotation and/or the drive action of the foot pedal 104. In various embodiments, cams 504 may be interchangeable by a user based on any desired rate of drive shaft 116 rotation, drive action, or the like. The illustration of FIG. 5 shows an example embodiment of an integral cam 504 and drive lever 108. In some embodiments, a cam component 504 may be detachable from the lever portion of the drive lever 108 allowing, for example, interchangeable cam components 504 using the same drive lever component. In other embodiments, interchangeable integral cam and drive lever components 108 (as shown in FIG. 5) may be available.

At illustration C) of FIG. 5, drive lever 108 is shown with a direct link mechanism 506 as a cam device 110 (or connection device 110). In an embodiment, a solid or semi-flexible link (e.g., direct link 506 plus a shaft, rod, etc.) may be used in place of a flexible strap or chain 118 to attach the foot pedal 104 to the drive mechanism (e.g., drive shaft 116 and mandrel 114). For example, depressing the foot pedal 104 pulls on the direct link 506 and chain 118, rod, etc. which rotates the mandrel 114 and drive shaft 116 via the drive lever 108. The length of the direct link 506 may determine a rate of drive shaft 116 rotation and/or the drive action of the foot pedal 104. In various embodiments, direct links 506 (of various materials, lengths, flexibility, etc.) may be interchangeable by a user based on any desired rate of drive shaft 116 rotation, drive action, or the like. In various embodiments, direct links 506, including rods, shafts, etc. may be constructed of various metals, plastics, fiberglass, and the like, or combinations, to provide the desired drive action.

In one implementation, the cam device 110 is pivotally adjustable with respect to the lever 108. For example, as shown in FIGS. 4 and 5, a cam device 110, such as the sprocket 502 (or partial sprocket 502) may include multiple mounting holes 508 arranged to mount the sprocket 502 to the lever portion of drive lever 108. Mounting the sprocket 502 into one of the multiple holes 508 changes the drive action of the driver lever 108 when actuated by the footboard 104. Accordingly, a user can adjust the drive action of the pedal assy 100 in this manner as well. In alternate implementations, any number of mounting holes 508 may be available on a sprocket 502, or other cam device 110.

Example Adjustable Heel Plate

The footboard (i.e., foot pedal) 104 can also be moved forward and rearward relative to the drive shaft 116 to further increase the adjustment possibilities of the pedal assy 100. For example, the footboard 104 may include the foot pedal portion (that is depressed by the user's foot when in operation) and may also include various components that couple the foot pedal portion to the base 120 of the pedal assy 100.

In one embodiment, referring to FIGS. 1, 2, 3, and 6, the footboard 104 is coupled to an adjustable heel plate 112, which is coupled to the base 120 of the pedal assembly 100. In an embodiment, the heel plate 112 may be adjusted by turning a screw-type adjuster 602 (e.g., a worm screw, or the like) at the front or rear of the heel plate 112. For example, the heel plate 112 may be coupled to the rear portion of the footboard 104 (by axles 124 shown in FIGS. 1-3, for example) and to the rear portion of the base 120 of the pedal assembly (with screws, rivets, or like fasteners, etc.). In one embodiment, the footboard 104 is coupled to the "block" 604 shown in FIG. 6. A bolt 602 or other screw-type adjuster may be used to move the block 604 forward and backward with respect to the base 120 of the pedal assembly 100. This causes the footboard 104 to move with respect to the base 120 of the pedal assembly 100, and with respect to the drive shaft 116 at the front of the pedal assembly 100.

Figure 6:
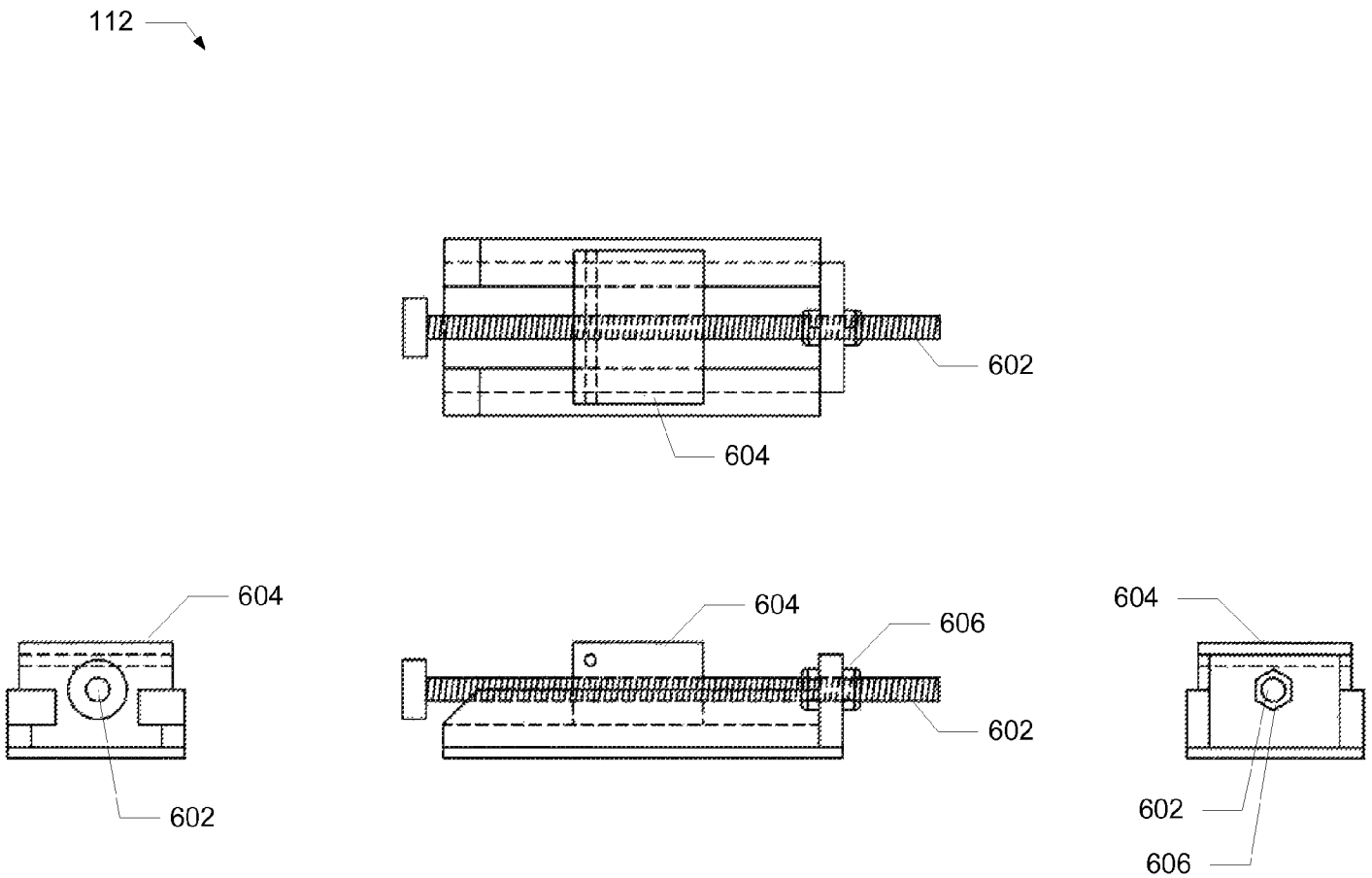
FIG. 6 illustrates details of an example heel plate adjustment assembly according to an embodiment.

For example, as shown in FIG. 6, the bolt 602 may be stationary with respect to one or more stops on the heel plate 112 assembly, and allowed to rotate, and the block 604 may be moveable with respect to the bolt 602. The block 604 may be threaded, for example, and move forward and backward as the bolt 602 is rotated in either direction. In various other embodiments, the block 604 may be coupled to the bolt 602 by other attachment means, where the attachment means move with the rotation of the bolt 602, and the block 604 is fixed to the other attachment means. Attachment means may include a bearing, a nut, a sleeve, a plug, or the like.

In one embodiment, as shown in FIG. 6, one or more locking fasteners 606 (e.g., locknuts, etc.) may be used to hold the block 604 and footboard 104 in relative position to the base 120 of the pedal assembly 100 once the desired adjustment position is achieved by turning the bolt 602. In various other embodiments, other means may be used to secure the footboard 104 into the desired adjustment position (clips, screws, pins, and so forth).

A screw-type adjustment, such as the adjustment bolt 602 (e.g., worm screw, etc.) shown in FIG. 6, provides an infinite number of adjustment increments to the user. For example, in an embodiment, the bolt 602 is arranged to adjust the heel plate 112 in one of an infinite quantity of positions with respect to the base 120 of the drum pedal assembly 100. This is in contrast to utilizing only fixed stops as some models have, which limit the adjustment range to predetermined increments. Using a screw or bolt 602 allows many finer adjustments to be made, and also provides assurance that adjustments remain fixed in position (e.g., by using locknuts, etc. on the bolt).

The whole feel of the pedal assembly 100 can be customized to the drummer's choice. Once a "sweet spot" has been found, all of the settings can be locked in by tightening the setscrews 202 in the mandrel 114 and a locknut 606 at the end of the heel plate 112 adjustment screw 602, for example. All of these adjustments can be made by the player, from a playing position, without removing the pedal assy 100 from the drum.

Figure 7:
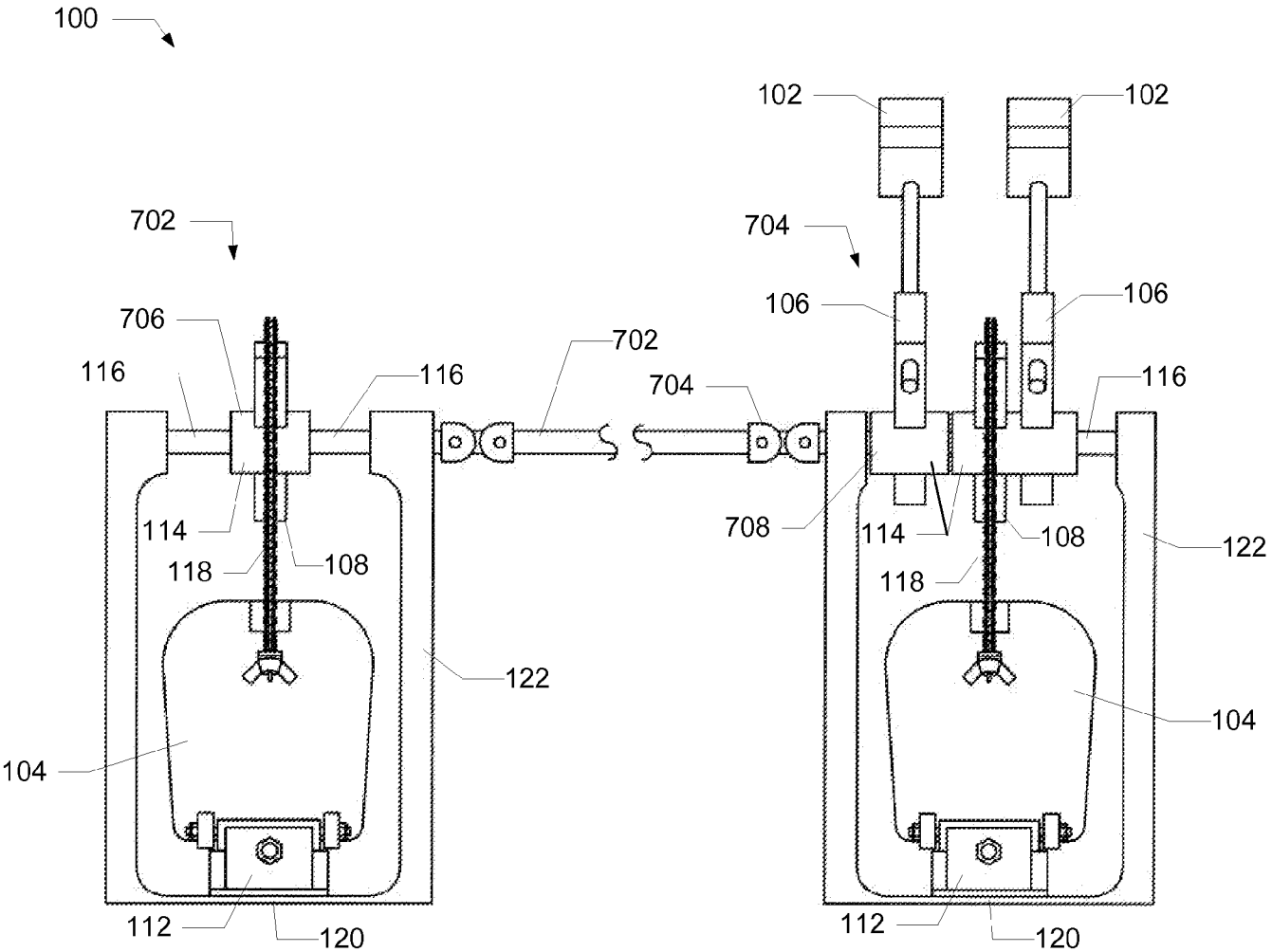
FIG. 7 illustrates a front view of an example double-beater, double-pedal implementation.

The adjustment mechanisms are also available in a double pedal configuration of the pedal assy 100, as shown in the illustration of FIG. 7. In one embodiment, this is done by splitting a mandrel 114 into two or more segments: a drive lever segment 706 on the slave pedal 702, and a beater lever segment 708 as the second beater 102 on the main pedal 704. A second heel-plate adjuster 112 may be used on the slave pedal 702 as well. Further, any number of pedals may be linked together in like manner to form a pedal assy 100. One or more of the adjustment techniques and/or devices may be used with each pedal if desired.

The components discussed herein with respect to the pedal assy 100 are intended to be used in the production of new drum pedals or in the retro-fitting of existing drum pedals. In various embodiments, existing drum pedals may be upgraded or re-fitted with one or more of the adjustment components (114, 106, 108, and/or the heel plate adjustment assembly 112) and/or techniques either individually or in various combinations.

In some implementations, the drum pedal assembly 100 uses a one-piece footboard 104. In other implementations, a hinged-footboard or a "longboard" footboard 104 is used. In various embodiments, the heel-plate adjuster assembly 112 is designed to work with one-piece footboards 104 attached to the rear axle 124 mount, or with a hinged footboard attached to the front axle mount, in which case the block device 604 may serve as the heel plate for the hinged footboard.

As discussed above, the techniques, components, and devices described herein with respect to the implementations are not limited to the illustrations of FIGS. 1-7, and may be applied to other pedal and/or actuator devices, and designs, without departing from the scope of the disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that a pedal assembly 100 may be implemented as a stand-alone device or as part of another system (e.g., integrated with other components, systems, etc.). In various implementations, additional or alternative components may be used to accomplish the disclosed techniques and arrangements.

Advantages

The embodiments described herein provide a range of adjustments and/or an ease of adjustment. With the embodiments, the pedal assy 100 does not have to be removed from the drum and turned upside down to be adjusted, for example. Also, the embodiments are infinitely adjustable; instead of being limited to fixed adjustment positions. The disclosed embodiments are adjustable from the playing position, and have a much wider and more practical range of adjustment.

The embodiments disclosed have the ability to modify the leverage of the cam 110 relative to the attack angle $\alpha$ of the beater 102 to the head. This potentially eliminates an incorrect forward angle $\alpha$ position, with adjustability of the distance of the beater 102 from the drumhead in the striking position (as shown in FIG. 3), resulting in better rebound, because the beater 102 doesn't have to travel in an uphill arc on its rebound. The one or more adjustable levers (106, 108) provide "reach," that can be set so that a beater 102 hits the drumhead at a parallel angle to the head, or may be set closer to the drumhead, which gives the maximum rebound.

In addition, the cam 110, which is arranged to convert the downward energy of the footboard 104 into a rotary motion of the drive shaft 116, is adjustable for leverage relative to the position of the beater 102, which sets the camber $\alpha$ of the beater 102, since it is coupled to an adjustable drive lever 108. Additionally, the footboard 104 is adjustable forward and rearward via a screw-type device 602, which allows a wide adjustment range and a very fine adjustment.

Representative Process

Figure 8:
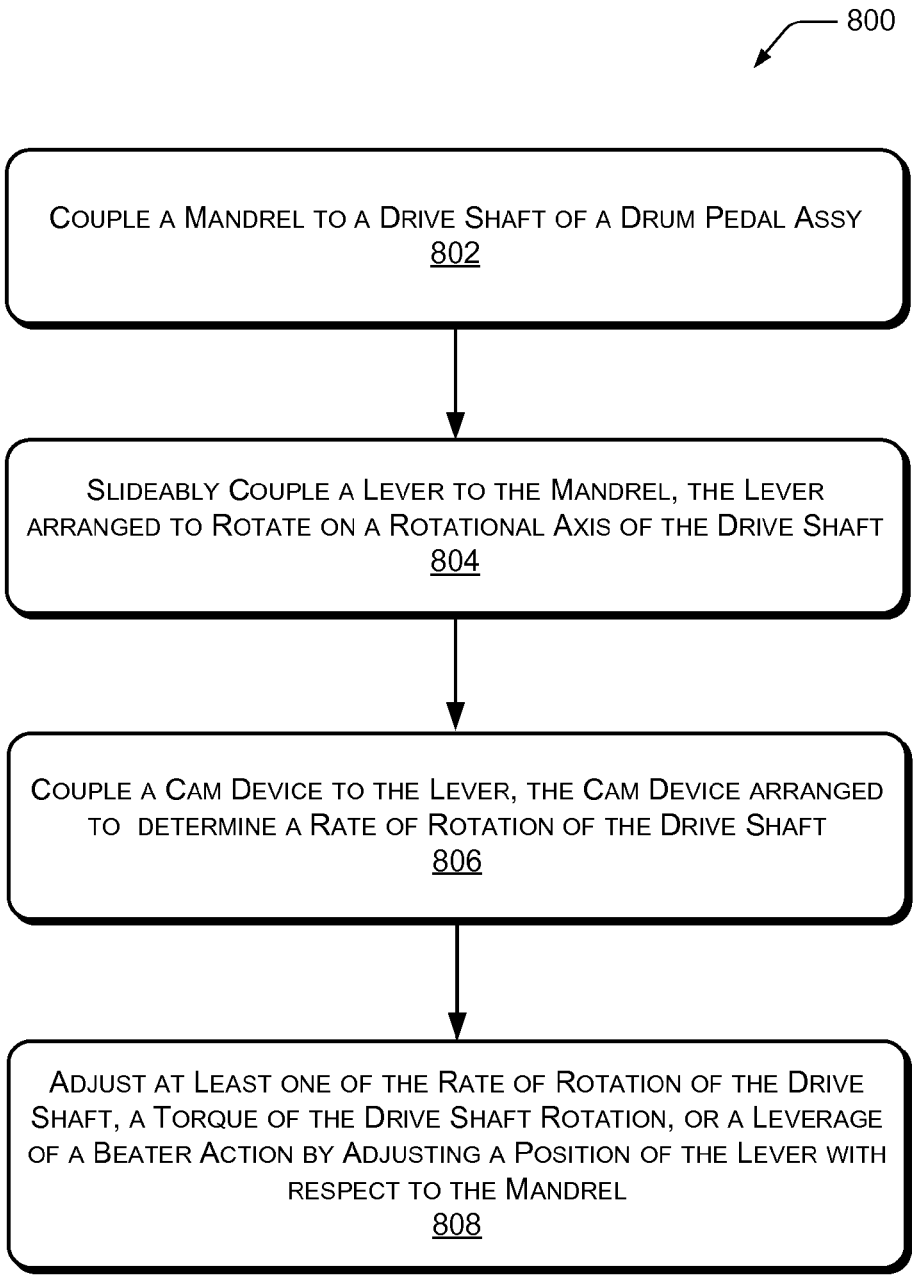
FIG. 8 illustrates a flow diagram of a method of adjusting one or more parameters of an adjustable drum pedal, according to an implementation.

FIG. 8 is a flow diagram illustrating an example process 800 for providing adjustments to a drum pedal (such as pedal assy 100, for example), according to an implementation. The process 800 is described with reference to FIGS. 1-7.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable materials, or combinations thereof, without departing from the scope of the subject matter described herein.

At block 802, the process includes coupling a mandrel (such as mandrel 114, for example) to a drive shaft (such as drive shaft 116, for example) of a drum pedal assembly. In various implementations, the mandrel may be coupled to the pedal assembly as a new installation or as a re-fit, retro-fit, up-grade, and the like.

At block 804, the process includes slideably coupling a lever (such as drive lever 108, for example) to the mandrel. In an implementation, the lever is arranged to rotate on a rotational axis of the drive shaft.

At block 806, the process includes coupling a cam device (such as cam device 110, for example) to the lever. In an embodiment, the cam device is arranged to determine a rate of rotation of the drive shaft.

At block 808, the process includes adjusting at least one of the rate of rotation of the drive shaft, a torque of the drive shaft rotation, or a leverage of a beater action by adjusting a position of the lever with respect to the mandrel. In an implementation, the lever is infinitely adjustable within the length of the lever, being slideable within the mandrel. In one example, the lever may be fixed in a desired position with a set screw or like fastener.

In an implementation, the process includes coupling one or more additional levers (such as beater lever 106, for example) to the mandrel. In an embodiment, one or more of the additional levers are infinitely adjustable within the length of the lever(s), being slideable within the mandrel.

In an implementation one or more of the lever or the additional levers are arranged to rotate on the rotational axis of the drive shaft. In one embodiment, the mandrel is arranged to rotate on the rotational axis of the drive shaft.

In an additional implementation, the process includes coupling a heel plate adjustment device (such as heel plate 112, for example) to the drum pedal assembly, which is arranged to adjust a footboard of the drum pedal forward or backward along a base of the drum pedal, a desired distance from the drive shaft.

In an implementation, one or more of the lever adjustments and/or the heel plate adjustments are arranged to be made from the sitting or playing position, without removing the drum pedal from its location at the drum.

In an example scenario, a user may make one or more adjustments to a drum pedal as follows: In various embodiments, only one or some of the adjustments described may be available. The steps described are not listed in a limiting order, and may be performed in any order desired.

A user inserts the beater 102 of his or her choice into the beater lever 106. The pedal footboard 104 is pressed down until the beater 102 makes contact with the drumhead. The beater lever 106 can be adjusted forward until the beater 102 shaft is parallel with the head upon contact, or to the point the player wishes. This can be performed by sliding the beater lever 106 through an opening 402 in the mandrel 114. The beater lever 106 may be secured in place using a set screw 202 or like fastener, for example.

The drive lever 108 and the footboard 104 position can be adjusted to achieve the player's desired feel, action, and speed, until the player is satisfied that the best result has been achieved. This can be performed by sliding the drive lever 108 through another opening 402 in the mandrel 114. The drive lever 108 may be secured in place using a set screw 202 or like fastener, for example. The user may start with a setting where the cam face sits about ½" ahead of the center of the beater shaft, for instance, and then move the drive lever 108 in the desired direction (forward or backward within the opening 402 in the mandrel 114) until the best result is achieved. The beater lever 106 and/or the drive lever 108 may be readjusted by loosening the respective set screws 202, repositioning the lever(s) 106, 108, and tightening the set screws 202 Infinite adjustments are possible by sliding the lever(s) 106, 108 into the desired positions.

The chain 118 angle and the footboard 104 position may be adjusted to get the desired result, if available. All adjustments may be locked in by tightening the setscrews and locknuts. A mark may be made with a felt marker, or the like, on the sliding lever(s) 106, 108 and the footboard 104 position to recall the adjustments, if desired.

In alternate implementations, other techniques may be included in the process 800 in various combinations, and remain within the scope of the disclosure.

Conclusion

While various discreet embodiments have been described throughout, the individual features of the various embodiments may be combined to form other embodiments not specifically described. The embodiments formed by combining the features of described embodiments are also adjustable drum pedals.

What is claimed is:

1. A drum pedal assembly comprising:

a mandrel coupled to a drive shaft of the drum pedal assembly;

a cam device arranged to determine a rate of rotation of the drive shaft;

a first lever coupled to the cam device and slideably coupled to the mandrel, the first lever operative to adjust a distance of the cam device from the drive shaft;

a beater device arranged to strike a percussion surface;

a second lever coupled to the beater device and slideably coupled to the mandrel, the second lever operative to adjust a camber of the beater device with respect to the percussion surface;

a footboard arranged to actuate the drive shaft; and a heel plate coupled to the footboard and slideably coupled to a base of the drum pedal assembly, the heel plate operative to adjust a distance of a point on the footboard from the drive shaft.

2. The drum pedal assembly of claim 1, wherein the mandrel is coupled to the drive shaft such that a center axis of the mandrel is aligned to a center axis of the drive shaft, the center axis of the drive shaft comprising a rotational axis of the drive shaft.

3. The drum pedal assembly of claim 1, wherein the mandrel is coupled to the drive shaft such that a center axis of the mandrel is offset from a center axis of the drive shaft, the center axis of the drive shaft comprising the rotational axis of the drive shaft.

4. The drum pedal assembly of claim 1, wherein at least one of the first and second levers rotates on a rotational axis of the drive shaft.

5. The drum pedal assembly of claim 1, wherein the first lever is arranged to be slideably adjusted in one of an infinite quantity of positions along a length of the first lever and/or the second lever is arranged to be slideably adjusted in one of an infinite quantity of positions along a length of the second lever.

6. The drum pedal assembly of claim 1, wherein the mandrel includes a channel through the mandrel, the channel being perpendicular to a rotational axis of the mandrel, and wherein at least one of the first and second levers is inserted into the channel.

7. The drum pedal assembly of claim 1, wherein the mandrel includes at least two channels through the mandrel, each channel being perpendicular to a rotational axis of the mandrel, and wherein the first and second levers are inserted into one each of the at least two channels.

8. The drum pedal assembly of claim 7, wherein the at least two channels are parallel to each other.

9. The drum pedal assembly of claim 1, wherein the heel plate includes a worm screw arranged to adjust the heel plate in one of an infinite quantity of positions with respect to the base of the drum pedal assembly.

10. The drum pedal assembly of claim 1, wherein at least one of the first lever, the second lever, and the heel plate of the drum pedal assembly is arranged to be retrofitted onto an existing drum pedal.

11. The drum pedal assembly of claim 1, further comprising a second mandrel operatively independent of the mandrel, the second mandrel coupled to the drive shaft such that a center axis of the second mandrel is aligned to a center axis of the drive shaft, the center axis of the drive shaft comprising a rotational axis of the drive shaft;

a second beater device arranged to strike a percussion surface; and a third lever coupled to the second beater and slideably coupled to the second mandrel such that the third lever rotates on the rotational axis of the drive shaft.

12. A drum pedal assembly comprising:

a mandrel coupled to a drive shaft of the drum pedal assembly;

a cam device arranged to determine a rate of rotation of the drive shaft; and a lever coupled to the cam device and slideably coupled to the mandrel, the lever operative to adjust a distance of the cam device from the drive shaft, the lever arranged to rotate on a rotational axis of the drive shaft.

13. The drum pedal assembly of claim 12, further comprising a beater device coupled to the drive shaft and arranged to strike a percussion surface based on a rotation of the drive shaft.

14. The drum pedal assembly of claim 13, further comprising a second lever coupled to the beater device and slideably coupled to the mandrel, the second lever operative to adjust a camber of the beater device with respect to the percussion surface.

15. The drum pedal assembly of claim 12, wherein the lever is arranged to be slideably adjusted in one of an infinite quantity of positions along a length of the lever.

16. The drum pedal assembly of claim 12, wherein the mandrel is coupled to the drive shaft such that a center axis of the mandrel is aligned to a center axis of the drive shaft, the center axis of the drive shaft comprising the rotational axis of the drive shaft.

17. The drum pedal assembly of claim 12, wherein the drive shaft comprises two or more shaft sub-sections, each of a first end and a second end of the mandrel being coupled to a shaft sub-section.

18. The drum pedal assembly of claim 12, wherein the cam device comprises an interchangeable drive head, the interchangeable drive head being interchangeable between a partial-sprocket, a smooth cam, or a direct link component.

19. The drum pedal assembly of claim 12, wherein the cam device is pivotally adjustable with respect to the lever.

20. A method, comprising:

coupling a mandrel to a drive shaft of a drum pedal assembly;

slideably coupling a lever to the mandrel, the lever arranged to rotate on a rotational axis of the drive shaft;

coupling a cam device to the lever, the cam device arranged to determine a rate of rotation of the drive shaft; and adjusting at least one of the rate of rotation of the drive shaft, a torque of the drive shaft rotation, or a leverage of a beater action by adjusting a position of the lever with respect to the mandrel.

* * * * *